US009189950B2

(12) United States Patent
Best

(10) Patent No.: US 9,189,950 B2
(45) Date of Patent: Nov. 17, 2015

(54) HYGIENE MONITORING SYSTEM

(75) Inventor: Kenneth Alaric Best, Lancaster (GB)

(73) Assignee: Veraz Limited (GB)

( * ) Notice: Subject to any disclaimer, the term of this patent is extended or adjusted under 35 U.S.C. 154(b) by 0 days.

(21) Appl. No.: 13/504,627

(22) PCT Filed: Oct. 27, 2010

(86) PCT No.: PCT/GB2010/051801

§ 371 (c)(1),
(2), (4) Date: Jul. 5, 2012

(87) PCT Pub. No.: WO2011/051713

PCT Pub. Date: May 5, 2011

(65) Prior Publication Data

US 2012/0268277 A1 Oct. 25, 2012

(30) Foreign Application Priority Data

Oct. 27, 2009 (GB) ..... 0918767.5

(51) Int. Cl.
*G08B 23/00* (2006.01)
*G08B 21/24* (2006.01)

(52) U.S. Cl.
CPC ..... *G08B 21/245* (2013.01)

(58) Field of Classification Search
CPC ..... G06F 19/327; G06F 19/3418; G06F 19/3493; A47K 2005/1218; A47K 5/12; A47K 5/1202; A61L 2/18; A61L 2/24
USPC ..... 340/573.1, 539.1–539.13
See application file for complete search history.

(56) References Cited

U.S. PATENT DOCUMENTS

| | | | | |
|---|---|---|---|---|
| 5,610,589 | A * | 3/1997 | Evans et al. | 340/573.1 |
| 5,908,143 | A * | 6/1999 | Crossdale et al. | 222/52 |
| 6,392,546 | B1 * | 5/2002 | Smith | 340/573.1 |
| 6,882,278 | B2 * | 4/2005 | Winings et al. | 340/573.1 |
| 7,242,307 | B1 * | 7/2007 | LeBlond et al. | 340/573.1 |
| 7,315,245 | B2 * | 1/2008 | Lynn et al. | 340/540 |
| 7,375,640 | B1 | 5/2008 | Plost | |
| 7,598,854 | B2 * | 10/2009 | Wong | 340/539.13 |
| 7,804,409 | B2 * | 9/2010 | Munro et al. | 340/572.1 |
| 7,893,842 | B2 * | 2/2011 | Deutsch | 340/573.1 |
| 7,952,484 | B2 * | 5/2011 | Lynn | 340/573.1 |
| 8,294,584 | B2 * | 10/2012 | Plost | 340/573.1 |

(Continued)

FOREIGN PATENT DOCUMENTS

| | | |
|---|---|---|
| EP | 1872802 A1 | 1/2008 |
| JP | 2001067568 | 3/2001 |

(Continued)

*Primary Examiner* — Eric M Blount
(74) *Attorney, Agent, or Firm* — Salter & Michaelson

(57) ABSTRACT

The present invention relates to a system suitable for monitoring the contamination potential associated with one or more mobile objects within an environment containing one or more fixed or mobile sources of contamination or cleansing. The system comprises a plurality of signal indicator devices connected to the or each source, each indicator device emitting a signal. The system further comprises a monitoring device connected to the or each object, the monitoring device being operable to: detect signals of the type emitted by an indicator device; infer the occurrence of contact between an object and a source from a detected signal; determine a level of contamination risk from the inferred contact; and output a status signal indicative thereof.

21 Claims, 5 Drawing Sheets

(56) References Cited

U.S. PATENT DOCUMENTS

| | | | | |
|---|---|---|---|---|
| 8,525,666 | B2 * | 9/2013 | Melker et al. | 340/539.11 |
| 2004/0090333 | A1 * | 5/2004 | Wildman et al. | 340/573.1 |
| 2006/0231568 | A1 * | 10/2006 | Lynn et al. | 222/52 |
| 2008/0001763 | A1 * | 1/2008 | Raja et al. | 340/573.1 |

FOREIGN PATENT DOCUMENTS

| | | | |
|---|---|---|---|
| WO | WO/02/21475 | A1 | 3/2002 |
| WO | WO/2009/097096 | A1 | 8/2009 |
| WO | WO/2010/026581 | A2 | 3/2010 |
| WO | WO/2010/099488 | A1 | 9/2010 |

* cited by examiner

HYGIENE MONITORING SYSTEM

TECHNICAL FIELD

The present invention relates to a system for monitoring hygiene and to one or more devices suitable for implementing such a system.

BACKGROUND OF THE INVENTION

In some environments hygiene or the avoidance of cross-contamination is of significant importance. As such, considerable precautions may be taken by persons operating in these environments. These precautions may include both specially adapted equipment and/or special operational procedures. Unfortunately, the existence of such equipment or procedures does not verify that they will be utilised correctly at all times. In the particular case of operational procedures it can be very difficult to adequately monitor an individual's actions at all times.

An example of such difficulties is illustrated by considering a hospital. Within a hospital infectious diseases may be spread from patient to patient by contact with medical staff and other products or equipment. Accordingly, most hospitals have strict hygiene protocols, in particular a strict protocol requiring medical staff to wash their hands after patient (or other potentially risky) contact. It has however also been well documented that poor compliance with such protocols are not uncommon. Additionally, without equally unreliable direct vigilance from other members of staff, it is very difficult to police an individual's compliance.

It is therefore an object of the present invention to provide a system that at least partially alleviates or overcomes the above problems.

SUMMARY OF THE INVENTION

According to a first aspect of the present invention there is provided a system suitable for monitoring contamination potential associated with one or more mobile objects within an environment containing one or more fixed or mobile potential sources of contamination or cleansing, the system comprising: a plurality of signal indicator devices connected to the or each source, each indicator device emitting a signal; a monitoring device connected to the or each object, the monitoring device being operable to: detect signals of the type emitted by an indicator device; infer the occurrence of contact between an object and a source from a detected signal; determine a level of contamination risk from the inferred contact; and output a status signal indicative thereof.

In the system of the present invention, by detecting a signal from an indicator device, a monitoring device can infer contact between an object and a source and hence that the object has been exposed to contamination or cleansing by the source. The status signal output in response thereto can thus enable ready and/or automatic monitoring of potential contamination of objects It can also enable such ready and/or automatic monitoring of whether following potential contamination there has been adequate cleansing of the object.

The object may be a mobile object. The object may be a person or an article as appropriate. In the case of multiple objects, each object may be a person or each object may be an article or the object may comprise a mixture of persons and articles. If the object is a person, the person may be a worker or visitor within the environment. If the object is an article, this may be an item of equipment for use within the environment.

The source may be a fixed or mobile source. The source may be a person, an article or area as appropriate. In the case of multiple sources, each source may be a person or each source may be an article or each source may be an area or the sources may comprise a mixture of persons, articles or areas. If the source is a person, the person may be a worker or visitor within the environment. If the source is an article, this may be an item of equipment for use within the environment. If the source is an area, this may be a storage area or other specialised area within the environment.

The indicator device may emit a signal or signals indicative of the source. The signal may be indicative of the type of source. In a simple scheme, the signal emitted by the indicator device may merely identify the source as a potential contamination source or as a potential cleansing source. In a more complex scheme, the indicator device may identify the type or nature of contamination/cleansing source to which it is connected.

In some implementations, each indicator device may be operable to emit a signal incorporating a unique identification code. The code can allow the monitoring device to identify the specific indicator device if required.

The monitoring device may infer contact from merely detecting a signal emitted by an indicator device. To avoid false inferences, a contact may only be inferred if the detected signal strength exceeds a threshold level and/or the detected signal duration exceeds a preset period or by some other signal characteristic e.g. a signal code. The contact inference threshold may differ for different sources.

For some sources, the contact inference threshold may include a determination of the contact quality. This may be based on the detected signal strength and/or duration. Additionally or alternatively, the determination of the contact quality may be based on or varied in response to other information encoded by the signal, a particular pattern of contact or any separate input thereto. For example, a cleaning source contact may be determined to be high quality if the associated detected signal has a strength exceeding a predetermined level for a duration exceeding a predetermined period.

Additionally or alternatively, the determination of the contact quality may involve extracting additional information from the detected signal or another signal. In such cases, the indicator device may monitor a contact using additional sensing means and output a signal indicative of the contact quality based on the output of the additional sensing means.

The monitoring device may classify the contamination risk according to any suitable classification scheme. The classification may have a number of levels of contamination risk. In one suitable scheme, the contamination risk may be classified as low, medium or high. In such classification schemes, the classification of the contamination risk may be varied from one level to another in response to each inferred contact. For instance, inference of a contact with a potential contamination source may raise the contamination risk by one or more levels; whereas inference of a contact with a cleansing source may reduce the contamination risk by one or more levels.

The status signal may be directly or indirectly indicative of the classification of the contamination risk. The monitoring device may be provided with a status display unit for outputting a visual indication of the contamination risk classification. This can provide a readily available indication of the contamination risk associated with an object at any given time.

The indication displayed by the status display unit may take the form of a colour, pattern, symbol or any suitable combination thereof as required or desired. For example, the status display unit may comprise a one or more of illuminable elements, which vary their illumination in response to variation in the status signal. The status display unit may comprise an LED display, a liquid crystal display, a simple lamp display or similar.

In some embodiments, the status display unit may be additionally or alternatively operable to output an audio indication of the contamination risk classification. This audio indication may be output periodically or continuously or in response to changes in contamination risk classification. The audio indication and/or its mode of operation may be varied according to the contamination risk classification. For instance, the audio indication may be provided only when a high contamination classification is determined.

The status display unit may be an integral part of the monitoring device. Alternatively, the status display unit may comprise a separate article in communication with the monitoring device. In such cases, the communication may be by means of any suitable wired or wireless link.

In one preferred embodiment, the signals emitted by the indicator device are electrical signals. In such embodiments, signals can only be detected by the provision of an electrical pathway between the indicator device and the monitoring device. This may be achieved if there is electrical contact between object and source and if there is corresponding electrical contact between the monitoring device and the object and between the indicator device and the source. The electrical contact may be direct or indirect. Typically, the electrical contact between the object and the source may be temporary. Accordingly, the indicator device is preferably directly or indirectly electrically connected to the source and the monitoring device is preferably directly or indirectly electrically connected to the object. The electrical signals may be low power signals. This can reduce or avoid the danger of electrocution or ignition.

The indicator devices may be provided with attachment means enabling attachment to the source. The attachment means may further comprise one or more electrical surfaces enabling electrical connections to be made between the indicator device and the source. Different forms of indicator device or attachment means may be provided adapted for connection to different sources.

The monitoring device may be provided with attachment means enabling attachment to the object. The attachment means may further comprise one or more electrical surfaces enabling electrical connections to be made between the monitoring device and the object. Different forms of monitoring device or attachment means may be provided adapted for connection to different objects.

In an alternative embodiment, the signals emitted by the indicator device are radio frequency signals. In such embodiments, signals can only be detected by sufficient proximity between the indicator device and the monitoring device.

The system may further comprise a management unit. The management unit may be in one way or two way communication with one or more monitoring devices and/or one or more indicator devices. The communication may be by way of any suitable wired or wireless link. In particular, the communication may be way of a radio frequency link. In particular the or each monitoring device may be operable to transmit the status signal to the management unit by way of the communication link. This can allow the management unit to store a record of contamination risk of any particular object over time. This can be used as a fail safe in the event of an elevated classification not being noticed within the environment and/or for the purpose of conducting contamination audits. The Management System may also be used to author protocols and appropriate to different conditions.

The system may be applied to the monitoring of hygiene in a Hospital or other health care environments. In such an example, monitoring devices may be connected to each member of staff. Also in such an example, indicator devices may be connected to patients, hospital equipment as potential contamination sources (including but not limited to beds, chairs, drip stands, diagnostic equipment, monitoring equipment or the like), hospital equipment as cleansing sources (including but not limited to: sinks, alcohol dispensers or the like).

In such an implementation, indicator devices for patients may have the form of a bracelet or similar and provided with suitable electrical contacts operable to emit an electrical signal onto the patient's skin. In such an implementation, indicator devices for other medical equipment or furniture may be provided with electrical contacts operable to emit an electrical signal across some or all of the surface of the equipment or furniture. In such an implementation, indicator devices for sinks may be provided with suitable electrical contacts operable to emit an electrical signal into the water flow of an associated tap. In such an implementation, indicator devices for alcohol dispensers may be provided with electrical contacts operable to emit an electrical signal across a dispenser control.

In such an implementation the monitoring device may comprise a package adapted to be carried about the person of a medical worker and provided with electrical contacts adjacent or in contact to the worker's skin. The monitoring device can thus detect a signal and hence infer contact whenever the worker touches a patient, equipment, sink or alcohol dispenser fitted with an indicator device. The monitoring device may be operable to classify the contamination risk as 'high' after each inferred contact with a patient or equipment and to classify the contamination risk as 'low' after each inferred contact with a sink or alcohol dispenser and a wash of appropriate quality. The monitoring device may also be operable to classify the contamination risk as 'uncertain' after each inferred contact with a patient The monitoring device may have either an integral or separate but connected status display unit. The status display unit may take the form of a badge to be affixed to the clothing of the worker. The status display unit may be operable to change colour to indicate risk classification. In a preferred scheme, red would indicate 'high' risk, amber/yellow would indicate 'uncertain' risk and green would indicate 'low' risk.

According to a second aspect of the present invention there is provided a method of monitoring the contamination potential associated with one or more objects within an environment containing one or more potential sources of contamination or cleansing, the method comprising attaching indicator devices to or in proximity to each source; attaching monitoring devices to each person or object, inferring contact between an object and a source by detecting with a monitoring device signals emitted by an indicator device; determining a level of contamination risk based on the inferred contact; and outputting a status signal indicative thereof.

According to a third aspect of the present invention there is provided a monitoring device suitable for monitoring and determining the contamination risk associated with an object within an environment containing one or more potential sources of contamination or cleansing, the monitoring device comprising: connection means for connecting the device to said object; a receiver operable to detect signals from indicator devices connected to a source in contact with the object; and a processing unit operable to infer contact between the object and a source from the detected signal, determine a level of contamination risk from the inferred contact and output a status signal indicative thereof.

According to a fourth aspect of the present invention there is provided an indicator device suitable for indicating the presence of a potential source of contamination or cleansing within an environment, the device comprising: connection means for connecting the device to said source; and an emitter operable to emit a signal indicative of the nature of said source.

The second, third and fourth aspects of the present invention may incorporate any features described in respect of the first aspect of the present invention as desired or as appropriate.

According to a fifth aspect of the present invention there is provided a kit of parts suitable for implementing the system of the first aspect of the present invention or the method of the second aspect of the present invention, the kit comprising: one or more monitoring devices according to the third aspect of the present invention; and one or more indicator devices according to the fourth aspect of the present invention.

The kit of the fifth aspect of the present invention may incorporate any features of the first four aspects of the present invention as desired or as are appropriate.

In order that the invention is more clearly understood, one implementation will now be described in more detail, by way of example only, and with reference to the accompanying drawings, in which:

DETAILED DESCRIPTION

In the example below, the present invention is described in relation to implementation in a hospital (or other such medical environment). The skilled man would appreciate that the invention could equally be applied to an industrial environment where contamination is an issue for instance a chemical processing plant or a semiconductor foundry.

Figure 1:
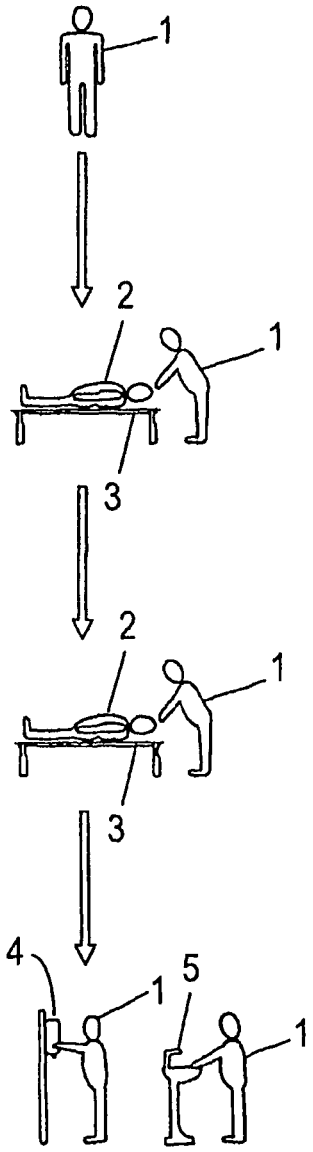
FIG. 1 is a schematic illustration of a sequence of duties of a medical worker.

Referring now to FIG. 1, in a typical hospital, a medical worker 1, may be involved in treating a series of different patients 2, typically disposed in beds 3. As such the worker 1, travels from patient to patient monitoring their condition and administering treatment as required. To reduce the possibility of cross infection, the worker 1 is usually required to clean their hands between successive contacts with different patients 2. This might be achieved by using an alcohol dispenser 4 or a sink 5. In the prior art, monitoring the correct washing protocol systematically is not possible.

Figure 2:
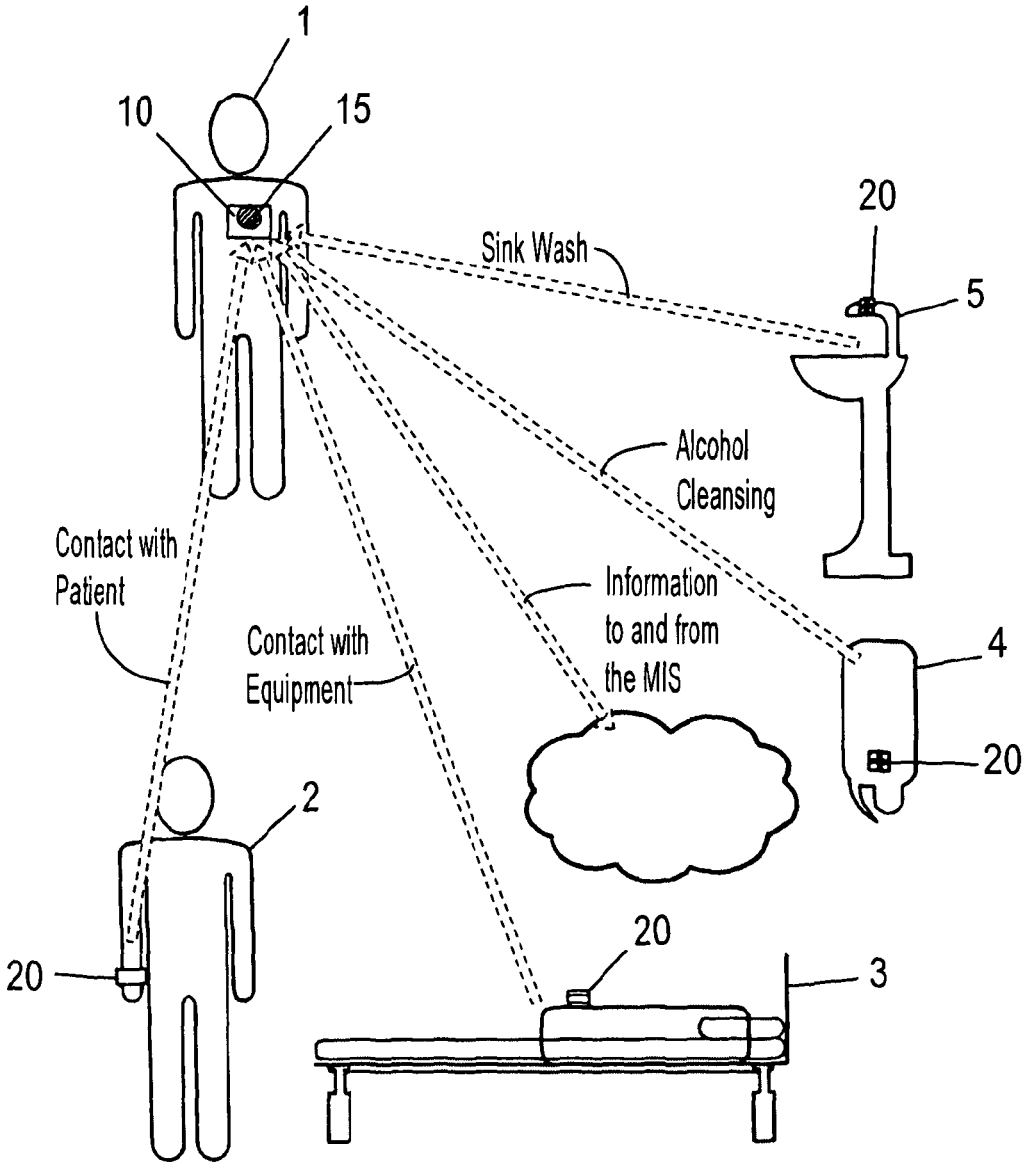
FIG. 2 is a schematic illustration of the components of a monitoring system according to the present invention in a hospital based implementation.
Figure 3:
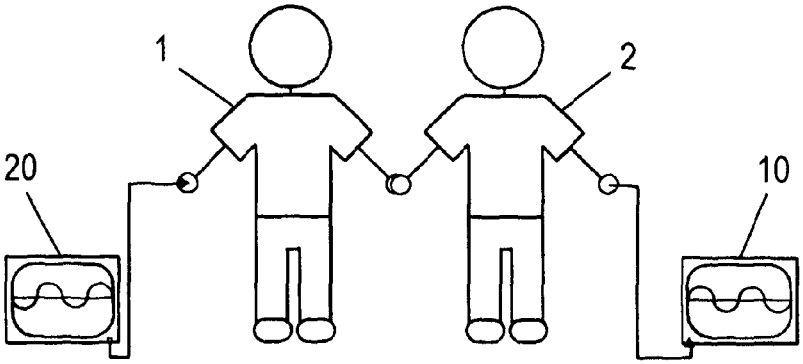
FIG. 3 is a schematic illustration of contact inference according to the present invention.

In the present invention, as is illustrated in FIG. 2, in order to monitor and verify compliance with the hand washing protocol, each worker 1 is provided with a hygiene monitoring device 10 and a number of sources of potential contamination or cleansing 2, 3, 4, 5 are fitted with an indicator device 20. The monitoring devices 10 are each arranged to be able to detect a small electrical signal applied to the worker's skin and the indicator devices 20 are each adapted to apply a small electrical signal to the source 2, 3, 4, 5. Accordingly, when a worker 1 touches a source 2, 3, 4, 5, an electrical signal may be passed from the source 2, 3, 4, 5 to the worker 1. This signal can be detected by the monitoring device 10 to infer that contact has taken place between the worker 1 and the source 2, 3, 4, 5. This is illustrated by FIG. 3.

By identifying the source 2, 3, 4, 5, the monitoring device 10 can determine whether the worker 1 now presents an increased contamination risk (i.e. they have touched a patient 2 or bed 3) or a reduced contamination risk (i.e. they have washed their hands using an alcohol dispenser 4 or sink 5). Information on this updated risk level can be indicated by means of a status display badge 15 and/or can be transmitted to a system management unit 30.

Figure 4A:
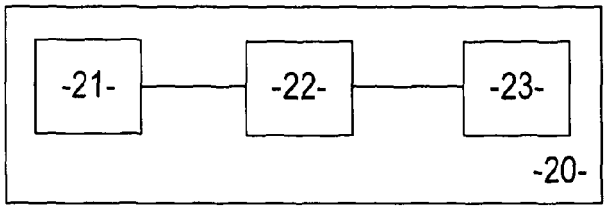
FIG. 4*a* is a schematic block diagram of an indicator device according to the present invention.

As shown in FIG. 4*a*, the indicator device 20 comprises electrical contacts 21, an electrical signal emitter 22 and a memory 23. The electrical contacts 21 may be incorporated into an attachment means (not shown) for attaching the indicator device to a particular source 2, 3, 4, 5. The contacts 21 are adapted to make an electrical connection with the surface or other conducting portion of the selected source 2, 3, 4, 5.

The emitter 22 emits a signal onto the conducting portion of the selected source 2, 3, 4, 5 via the contacts 21. The signal encodes information stored in memory 23. The information may be a code identifying the nature of the source 2, 3, 4, 5. Additionally or alternatively the memory 23 may also be pre-programmed with a unique code identifying the indicator device 20.

In some embodiments or for use with selected sources 2, 3, 4, 5, the indicator device 20 may be connected to additional sensing means (not shown). The additional sensing means may be operable to control the signal emitted by the emitter 22. The signal can thus be indicative not just of contact but of the quality of the contact. This is of particular import when considering cleansing sources 4, 5. In such circumstances, it is preferable to be able to infer, in addition to the existence of contact, that the contact was adequate or that the contact met at least some requirements for adequacy. In the present case, this might involve ensuring that sufficient alcohol is dispensed from a dispenser 4 or that a tap on a sink 5 has been run for a sufficient time.

Figure 5A:
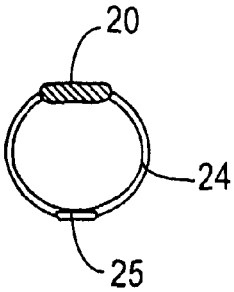
FIG. 5*a* shows an embodiment of an indicator device according to the present invention adapted to be worn by a patient.

One practical embodiment of the indicator device 20, for use by a patient 2, is shown in FIG. 5*a*. In this case, the indicator device 20 is provided on a patient identity bracelet 24, the bracelet 24 being fastened to the patient's wrist by use of a clasp 25 (or similar). The indicator device 20 is held against the skin such that the contacts 21 can apply an electrical signal thereto.

Figure 4B:
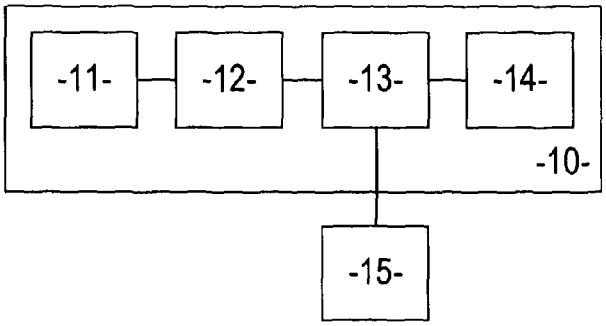
FIG. 4*b* is a schematic block diagram of a monitoring device according to the present invention.

As shown in FIG. 4*b*, the monitoring device 10 comprises electrical contacts 11, a receiver 12, a processing unit 13 and a transmitter 14. The electrical contacts 11 may be incorporated into an attachment means (not shown) for attaching at least the contacts 11 to the skin of the worker 1. The contacts 11 are adapted to make an electrical connection with the skin.

The contacts 11 are further connected to a receiver 12, which detects any electrical signals applied to the contacts 11.

The processing unit 13 is connected to the receiver 12 and is operable to identify any signals detected by the receiver 12. If the signals are identified as being emitted by an indicator device 20, the processing unit 13 can then infer that contact has taken place between the worker 1 and the source 2, 3, 4, 5 to which the indicator device 20 is connected. The processing unit 13 can also determine the quality of the contact, if required or desired. This can help determine the change in contamination risk. In a simple embodiment, this may be achieved by determining whether the detected signal strength and/or duration exceeds a predetermined threshold level. In another embodiment, it may be determined by extracting additional information from the indicator device 20 signal inserted in response to additional sensing means. This can allow the monitoring device to determine the level of cleaning or contamination involved in an inferred contact.

The processing unit 13 can thus reclassify the worker's contamination risk appropriately. In response to this reclassification, a status signal is output by the processing unit 13. The status signal may be output to the status display badge 15, such that the status display badge 15 can display an indication of the contamination risk. The status signal may also be output to the transmitter 14, which can transmit an indication of the contamination risk status of the worker 1 to the management unit 30.

Figure 5B:
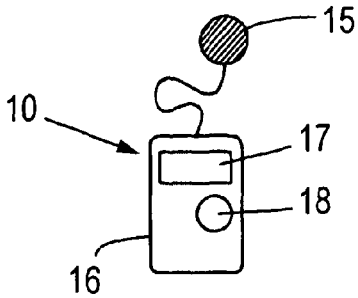
FIG. 5*b* shows an embodiment of a monitoring device according to the present invention adapted to be worn by a medical worker.

One practical embodiment of the monitoring device 10, for use by a worker 1, is shown in FIG. 5*b*. In this case, the monitoring device 10 is provided within a housing 16, having a display 17 and user actuable control 18. The housing can be clipped to a belt or worn on a special harness. The status display badge 15 is connected to the housing 1 via a cable 19.

Figure 6A:
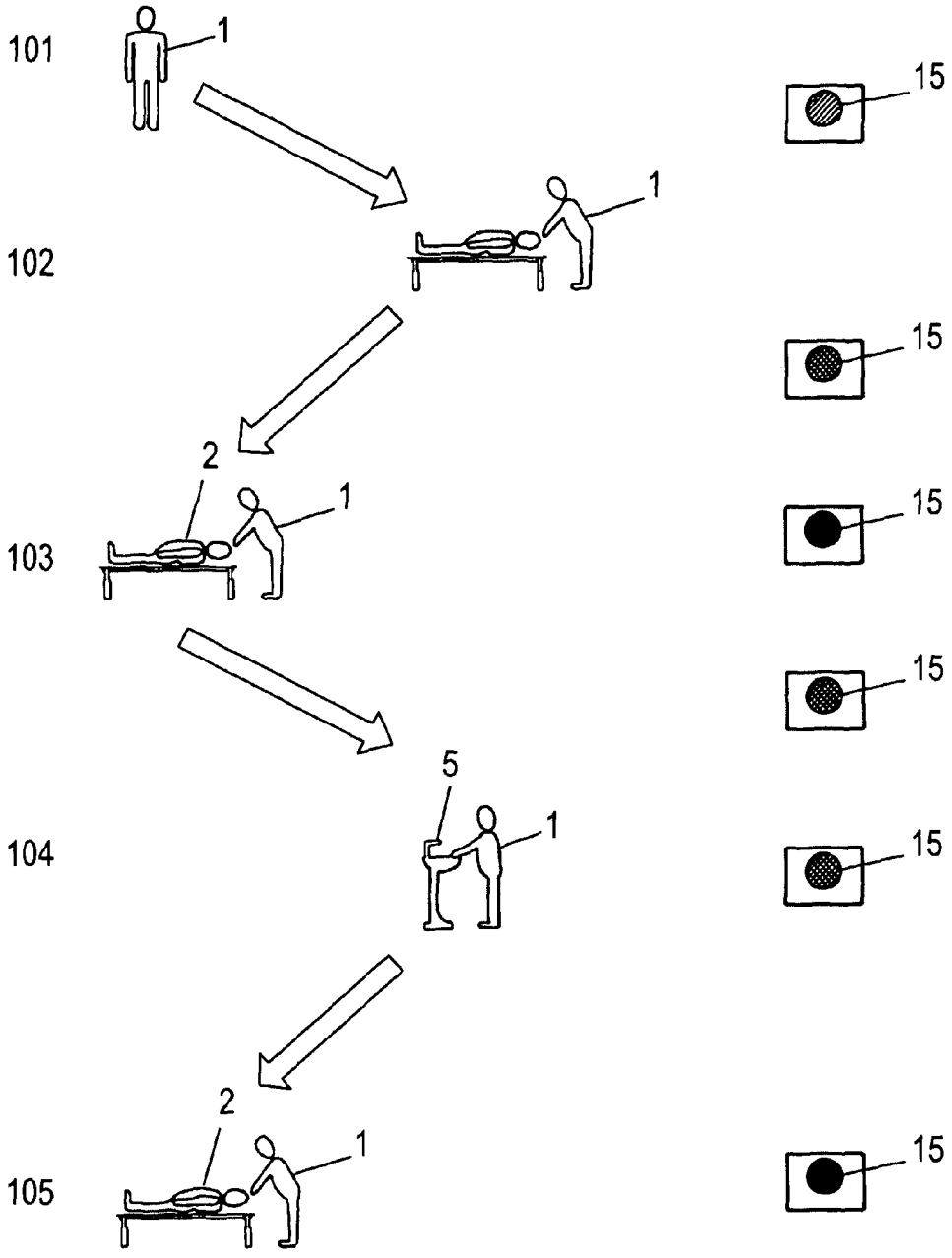
FIG. 6*a* is a schematic illustration of a sequence of duties of a medical worker monitored according to the present invention who is not complying with appropriate hand washing protocol.

Turning now to FIG. 6*a*, this shows an example of the system in operation where a worker 1 does not comply with hand washing protocol. At a first step 101, the worker 1 is clean and thus badge 15 displays a green colour. At the next step 102, the worker touches a patient 2, without stopping to wash their hands, and the monitoring device 10 infers contact. As a result badge 15 turns amber to indicate that the hygiene state of the worker is now uncertain. The initial amber signal is set so that the patient is not distressed. Contact with other sources of contamination may turn the badge 15 directly red.

At step 103, the worker 1 touches another patient 2 and the monitoring device 10 infers contact. As a result, the badge 15 turns red to indicate that the worker 1 may be contaminated. After noticing the badge 15, the worker 1 washes their hands at step 104. The hand washing contact is however determined to be of insufficient quality so the badge only reverts to amber, indicating uncertain risk status. When at step 105 another patient 2 is touched (and the touch is inferred by monitoring device 10), the status badge turns red to indicate a high risk of contamination.

Figure 6B:
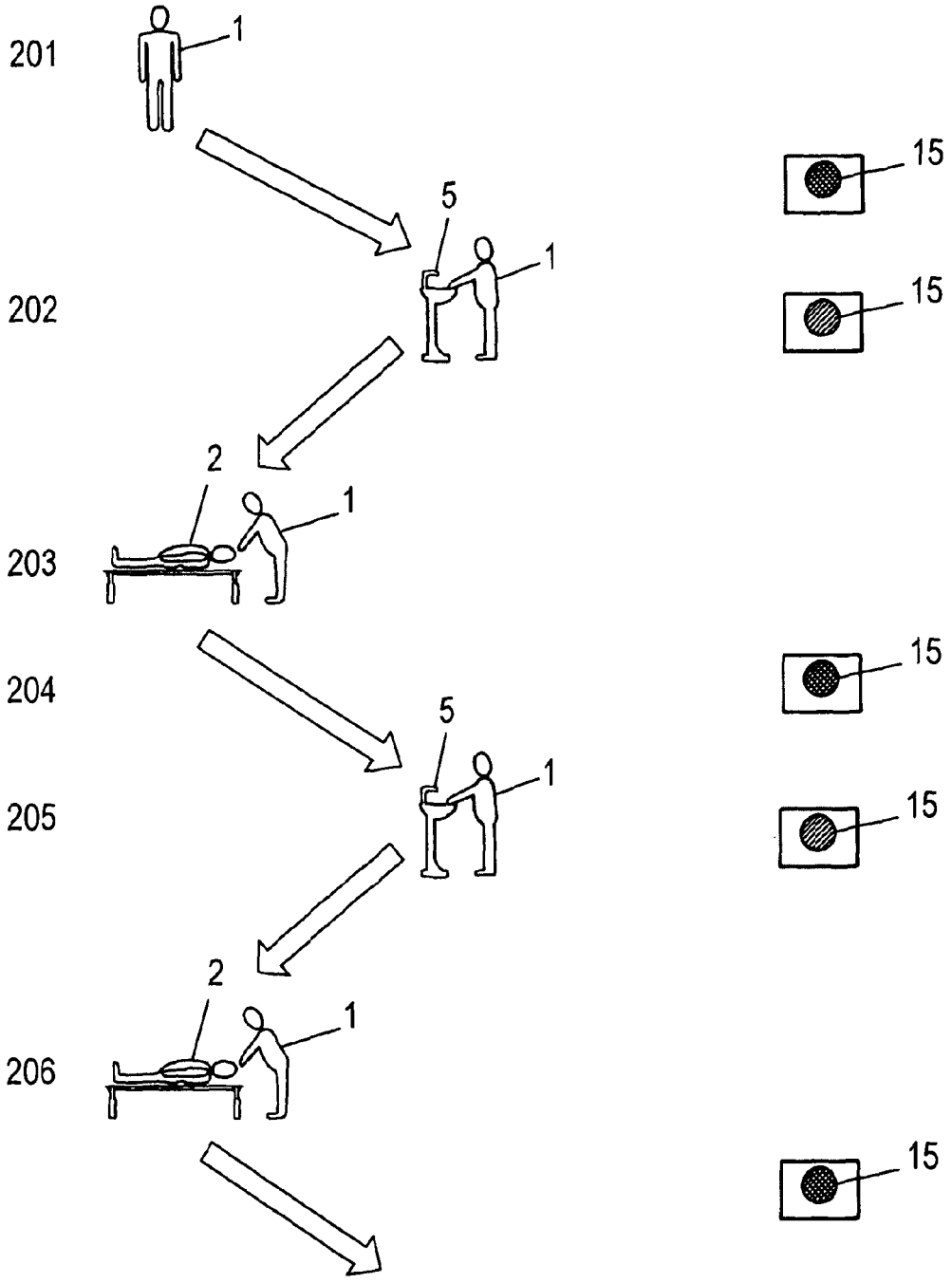
FIG. 6*b* is a schematic illustration of a sequence of duties of a medical worker monitored according to the present invention who is complying with appropriate hand washing protocol.

Turning now to FIG. 6*b*, this shows an example of the system in operation where a worker 1 does comply with hand washing protocol. At a first step 201, the worker 1 has just put on the monitoring device 10, so the badge 15 indicates amber, their risk status is uncertain. At the next step 202, the worker washes their hands and adequate contact is determined by the monitoring device 10. Accordingly they are classified as clean and thus badge 15 displays a green colour. At the next step 203, the worker touches a patient 2, without stopping to wash their hands, and the monitoring device 10 infers contact. As a result badge 15 turns amber to indicate that the hygiene state of the worker 1 is now uncertain.

At step 204, the worker 1 washes their hands. The hand washing contact is however determined to be of insufficient quality so the badge only reverts to amber, indicating uncertain risk status. As a result, the worker 1, at step 205, washes their hands again. At this stage, the contact is determined to be of sufficient quality, so badge 15 reverts to green. Subsequently at step 206, the worker 1 touches another patient 2 and the monitoring device 10 infers contact. As a result, the badge 15 turns amber to indicate that the worker 1 may be contaminated. The worker 1 should then proceed to wash their hands once more.

It is of course to be understood that the invention is not to be restricted to the details of the above embodiments which are described by way of example only.

What is claimed is:

1. A system suitable for monitoring contamination potential associated with one or more mobile objects within an environment containing one or more fixed or mobile potential sources of contamination or cleansing, the system comprising: a plurality of signal indicator devices connected to the or each source, each indicator device emitting an electrical signal; a monitoring device connected to the or each object, the monitoring device being operable to detect electrical signals of the type emitted by an indicator device via an instance of physical contact between an object and a source; establish the occurrence of touch contact between an object and a source from a detected signal; determine a level of contamination risk from the established contact; and output a status signal indicative thereof, wherein the electrical signal emitted by the indicator device is indicative of the type of source to which it is connected, and wherein the monitoring device includes an electrical contact disposed between the monitoring device and the object to detect an electrical signal and the indicator device includes another electrical contact disposed between the indicator device and the source to emit an electrical signal across the source.

2. A system as claimed in claim 1, wherein the indicator device is operable to emit a signal incorporating a unique identification code.

3. A system as claimed in claim 2, wherein the code allows the monitoring device to identify the specific indicator device.

4. A system as claimed in claim 1, wherein the monitoring device infers contact when the detected signal strength exceeds a threshold level and/or the detected signal duration exceeds a preset period.

5. A system as claimed in claim 4, wherein the contact inference differs for different sources.

6. A system as claimed in claim 1, wherein the monitoring device determines the contact quality based on the signal strength and/or signal duration.

7. A system as claimed in claim 1, wherein the indicator device further comprises a sensing means operable to monitor a contact, the indicator device outputting a signal indicative of the contact quality based on the output of the sensing means.

8. A system as claimed in claim 1, wherein the monitoring device classifies the contamination risk according to a classification scheme, the classification scheme comprising varying levels of contamination risk.

9. A system as claimed in claim 8, wherein the classification of the contamination risk varies from one level to another in response to each inferred contact or wherein the status signal is indicative of the classification of the contamination risk.

10. A system as claimed in claim 1, wherein the monitoring device is further provided with an integral or separate status display unit.

11. A system as claimed in claim 10, wherein the status display unit takes the form of a colour, pattern, symbol or a combination thereof, or is operable to output an audio indication, or is operable to change colour to indicate risk classification.

12. A system as claimed in claim 1, wherein the indicator device or the monitoring device is provided with attachment means enabling attachment to the source or object respectively.

13. A system as claimed in claim 12, wherein the attachment means comprises one or more electrical surfaces enabling electrical connections to be made between the indicator device and the source, or the monitoring device and the object.

14. A system as claimed in claim 1, wherein the system further comprises a management unit, said management unit being in one way or two way communication with one or more monitoring devices and/or one or more indicator devices.

15. A system as claimed in claim 14, wherein the management unit is operable to store a record of the contamination risk of any particular object or source over time.

16. A system as claimed in claim 1, wherein the indicator device comprises a bracelet to be worn about the person of a patient, the bracelet being provided with electrical contacts operable to emit an electrical signal onto the patient's skin, or wherein the object is a person and the monitoring device comprises a package adapted to be carried on that person, the package being provided with electrical contacts adjacent or in contact to the worker's skin.

17. A method of monitoring the contamination potential associated with one or more objects within an environment containing one or more potential sources of contamination or cleansing, the method comprising attaching indicator devices to or in proximity to each source; attaching monitoring devices to each person or object, establishing touch contact between an object and a source by detecting with a monitoring device electrical signals emitted by an indicator device following an instance of physical contact between an object and a source;

determining a level of contamination risk based on the established contact; and outputting a status signal indicative thereof wherein the electrical signal emitted by the indicator device is indicative of the type of source to which it is connected, and wherein the monitoring device includes an electrical contact disposed between the monitoring device and the object to detect an electrical signal and the indicator device includes another electrical contact disposed between the indicator device and the source to emit an electrical signal across the source.

18. A monitoring device suitable for monitoring and determining the contamination risk associated with an object within an environment containing one or more potential sources of contamination or cleansing, the monitoring device comprising: connection means for connecting the device to said object; a receiver operable to detect electrical signals from indicator devices connected to a source in physical contact with the object; and a processing unit operable to establish touch contact between the object and a source from the detected electrical signal, determine a level of contamination risk from the established contact and output a status signal indicative thereof, and wherein the monitoring device includes an electrical contact disposed between the monitoring device and the object to detect an electrical signal and the indicator device includes another electrical contact disposed between the indicator device and the source to emit an electrical signal across the source.

19. A system suitable for monitoring contamination potential associated with one or more mobile objects within an environment containing one or more fixed or mobile potential sources of contamination or cleansing, the system comprising: a plurality of signal indicator devices connected to the or each source, each indicator device emitting an electrical signal; a monitoring device connected to the or each object, the monitoring device being operable to detect electrical signals of the type emitted by an indicator device via an instance of physical contact between an object and a source; infer the occurrence of touch contact between an object and a source from a detected signal; determine a level of contamination risk from the inferred contact; and output a status signal indicative thereof, wherein the electrical signal emitted by the indicator device is indicative of the type of source to which it is connected, and wherein the monitoring device includes an electrical contact disposed between the monitoring device and the object to detect an electrical signal and the indicator device includes another electrical contact disposed between the indicator device and the source to emit an electrical signal across the source.

20. A system as claimed in claim 19, wherein the monitoring device further includes a receiver operable to detect electrical signals from indicator devices connected to a source and in physical contact with the object; and a processing unit operable to infer touch contact between the object and a source from the detected electrical signal, determine a level of contamination risk from the inferred contact and output a status signal indicative thereof.

21. A system as claimed in claim 1 wherein the monitoring device detects electrical signals only via an instance of physical contact between the object and source.

* * * * *